United States Patent [19]

Fuchs-Viniczay et al.

[11] 4,166,214

[45] Aug. 28, 1979

[54] OPTICAL-ELECTRICAL SYSTEM FOR MONITORING FILAMENTS, WIRES, STRANDS, TAPES AND THE LIKE

[75] Inventors: Gabriella Fuchs-Viniczay, Steinach; Kurt Huber, Arbon, both of Switzerland

[73] Assignee: Aktiengesellschaft Adolph Saurer, Arbon, Switzerland

[21] Appl. No.: 858,332

[22] Filed: Dec. 7, 1977

[30] Foreign Application Priority Data

Dec. 8, 1976 [CH] Switzerland ..... 15460/76

[51] Int. Cl.[2] ..... G02B 5/14

[52] U.S. Cl. ..... 250/227; 250/561

[58] Field of Search ..... 250/227, 561, 571; 350/96.15

[56] References Cited

U.S. PATENT DOCUMENTS

| | | | |
|---|---|---|---|
| 1,751,584 | 3/1930 | Hansell | 250/227 X |
| 3,255,357 | 6/1966 | Kapany et al. | 250/227 |
| 3,467,774 | 9/1969 | Bryant | 250/227 X |
| 3,999,864 | 12/1976 | Mutter | 250/227 X |

*Primary Examiner*—Lawrence J. Dahl

*Attorney, Agent, or Firm*—Finnegan, Henderson, Farabow & Garrett

[57] ABSTRACT

The present invention relates to an optical-electrical system for monitoring filaments etc. of narrow, fine configuration by means of an optical sensor, which includes one light guide mounted between a light source and the region monitored in which the filament is disposed, and another light guide between the monitored region and a photodetector.

2 Claims, 3 Drawing Figures

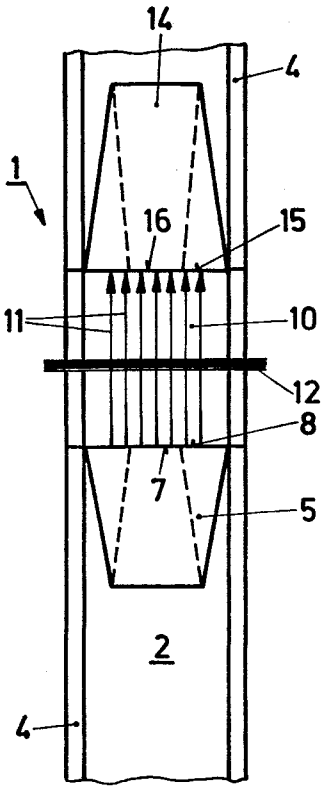
FIG. 2
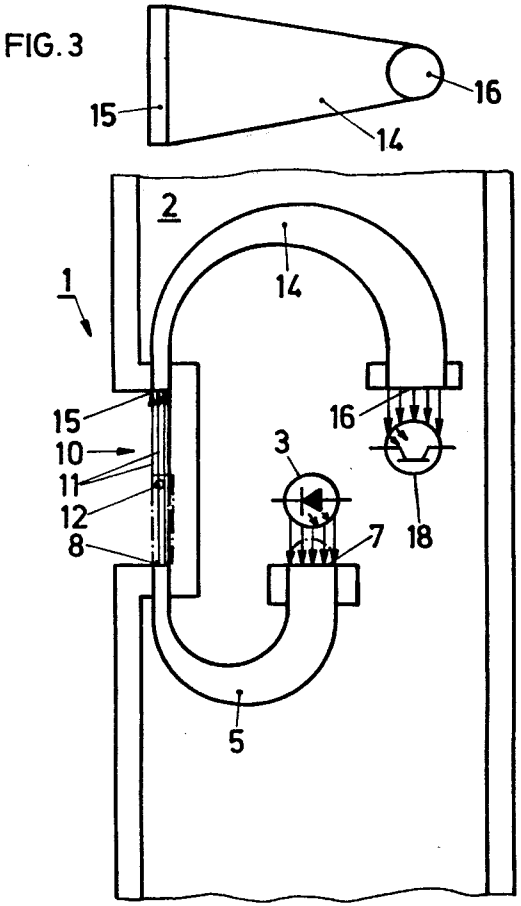
FIG. 3
FIG. 1

OPTICAL-ELECTRICAL SYSTEM FOR MONITORING FILAMENTS, WIRES, STRANDS, TAPES AND THE LIKE

Optical sensors including a light source and a detector are ordinarily used to detect or monitor objects approximately at least as large as or larger than the light beam passing from source to detector. Where this does not apply, such as where the object to be monitored is smaller than the light beam, costly optics and electronics are required to clearly discriminate between "bright" and "dark" signals. Particular difficulties arise when the optical sensors for detecting objects of lesser dimensions themselves are small because in such cases all the components, that is, the light source, the detector and the optics perforce also must be small.

Known optical sensors for the unambiguous detection of small structures, in particular narrow structures such as filaments, strands, wires etc. of narrow, fine configuration, are far too insenstive. The problem addressed by this invention consists in substantially increasing this sensitivity using simple means to that end, so as to provide a simple disign, which therefore is reliable and economical.

In that sense, this invention is characterized in that the IN and OUT end faces of the two light guides facing the monitored region are always designed as elongated rectangles with their longer sides parallel to the monitored structure, in that the IN face of the light guide mounted between the light source and the monitored region is of the same area but of different shape, preferably circular, as its OUT face, and in that the OUT face of the light guide mounted between the monitored region and the photodector is of the same area as but of a different shape, preferably circular, than its IN face.

The object of the invention is discussed below in relation to an embodiment and the drawing, which is purely schematic:

FIG. 1 is a side-view of a cut-out of an opticalelectrical filament monitor with optical sensor and embodying the present invention;

FIG. 2 is a front-view of the filament monitor of FIG. 1 and showing the monitored filament; and FIG. 3 shows a light guide of the optical sensor of FIGS. 1 and 2 showing IN and OUT faces one of which is circular and the other is an elongated rectangle.

FIGS. 1 and 2 show a cut-out filament monitor in which an optical sensor is disposed in a housing 2. This optical sensor includes a light source 3 emitting a beam of approximately circular cross-section. The rays of this beam arrive at a light guide with a circular IN face 7 and an elongated rectangular OUT face 8 forming a slit. For compactness, the light guide 5 bends the light around as shown, though in principle the guide 5 may also be straight.

Housing 2 provided with a groove or recess 10 in which is located the filament structure 12, as shown. The light rays 11 issuing from face 8 of the light guide 5 pass through this recess 10, many of them being intercepted by filament 12. The beam so attenuated arrives at a second light guide 14 having an IN face 15 which corresponds to the slit-like face 8. This light-guide 14 also is bent similarly to guide 5. Light-guide 14 terminates in an OUT face 16 of cross-sectional circular shape feeding the exit beam to a photodector 18.

Because light guide 5 changes the cross-section of the light beam to that of the monitored object, in this case to the narrow slit at the OUT face 8, which cross-sectioned light beam is also transmitted to IN face 15, the sensitivity of the optical sensor is appreciably increased, the thickness of filament structure 12 and the width of the light beam detecting it now being of the same order of magnitude.

Furthermore the means for increasing the sensitivity are exceedingly simple, not susceptible to interference and therefore economical. Thereby optimal conditions for monitoring filament 12 have beem created.

The radio of slit width to length ordinarily is within the range of 1:5 to 1:20. Obviously it is also possible to shape the IN face 7 of light guide 5 or the OUT face 16 of light guide 14 differently, for instance rectangularly, depending on the shape of the light source.

Such a system allows monitoring filament structures, furthermore wires, strands, tapes etc.

What is claimed is:

1. An optical-electrical system for monitoring elongated filaments, wires, strands, tapes and the like of narrow, fine configuration comprising a housing having a recess, a light source and a photodetector in said housing, a first light guide in said housing between said light source and one end of said recess, a second light guide in said housing between the other end of said recess and said photodetector, said light guides each having an IN and an OUT face which are equal in area, the OUT face of said first light guide and the IN face of said second light guide being aligned with one another and with said recess and being in the shape of an elongated rectangle, said recess being shaped to receive said elongated filaments, wires, strands, tapes and the like extending in a direction parallel to said elongated rectangular faces of said light guides, whereby a substantial portion of the light rays emitted from the OUT face of said first light guide are intercepted.

2. A optical-electrical system as defined in claim 1 wherein the IN face of said first light guide and the OUT face of said second guide are circular in shape.

* * * * *